US006499171B2

(12) United States Patent
Nappi, Sr.

(10) Patent No.: US 6,499,171 B2
(45) Date of Patent: Dec. 31, 2002

(54) FOOTWEAR CLEANING APPARATUS

(76) Inventor: John J. Nappi, Sr., 80 Beckley Rd., Berlin, CT (US) 06037

( * ) Notice: Subject to any disclaimer, the term of this patent is extended or adjusted under 35 U.S.C. 154(b) by 42 days.

(21) Appl. No.: 09/837,363

(22) Filed: Apr. 18, 2001

(65) Prior Publication Data

US 2002/0152566 A1 Oct. 24, 2002

(51) Int. Cl.[7] ..... A47L 23/02; A47L 23/06

(52) U.S. Cl. ..... 15/36; 15/30; 15/31; 15/32; 15/33; 15/34; 15/35; 15/161; 15/112

(58) Field of Search ..... 15/31, 32, 30, 15/34, 35, 161, 112

(56) References Cited

U.S. PATENT DOCUMENTS

| | | | | |
|---|---|---|---|---|
| 29,443 A | | 7/1860 | Shaler et al. | |
| 762,782 | | 6/1904 | Waters | |
| 825,512 | | 7/1906 | Brandes | |
| 895,458 | | 8/1908 | Herzog | |
| 983,138 | * | 1/1911 | Hecker | 15/36 |
| 1,033,613 | | 7/1912 | Olsen | |
| 1,189,559 | | 7/1916 | Gerber | |
| 1,471,826 | * | 10/1923 | Bzowy | 15/36 |
| 1,542,659 | | 6/1925 | Benincasa | |
| 2,436,234 | | 2/1948 | Stein | 15/161 |
| 2,944,278 | | 7/1960 | Bullard | 15/311 |
| 2,963,723 | | 12/1960 | Nappi | 15/36 |
| 3,066,338 | | 12/1962 | Nappi | 15/34 |
| 3,226,750 | | 1/1966 | Leonard | 15/36 |
| 3,831,217 | * | 8/1974 | Odawara | 15/34 |

* cited by examiner

*Primary Examiner*—Robert J. Warden, Sr.
*Assistant Examiner*—Shay Balsis
(74) *Attorney, Agent, or Firm*—Perman & Green, LLP

(57) ABSTRACT

Footwear cleaning apparatus includes a housing with an opening for receiving footwear to be cleaned. A first cylindrical brush is rotatably supported about a horizontal axis for cleaning the bottom of the footwear yielding to its insertion movement into the housing but preventing rotation in the opposite direction. A pair of second cylindrical brushes are rotatably supported about generally upright axes oppositely positioned adjacent the path of movement of the footwear for cleaning the sides of the footwear also in a manner yielding to its insertion movement but preventing rotation in the opposite direction. A third cylindrical brush also positioned in the path of movement of the footwear for cleaning its upper surfaces is rotatably supported about a substantially horizontally disposed axis on an axle extending between upright mounting braces for rotation, yielding to insertion movement of the footwear but preventing rotation in the opposite direction.

14 Claims, 6 Drawing Sheets

102
104
56
92
52
136
50
82
48
76
78
80
26
120
28
22
64
46
716
712
60
62
66
70
714
44
90
86
88
36
40
4
4
32
38
24
8
92
74
72
58
71
71
34
34
106
108
110
112

FIG.4
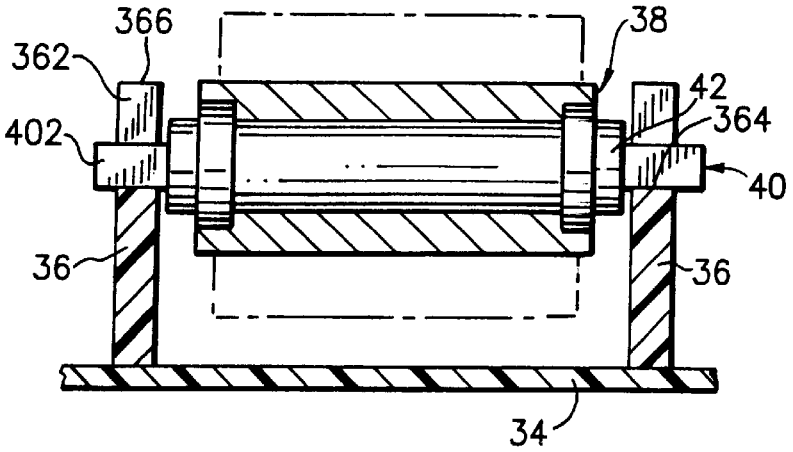
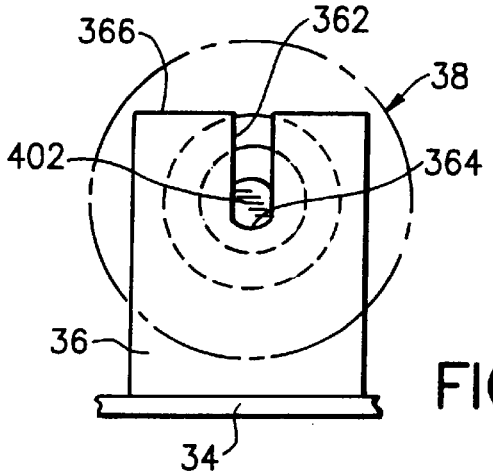
FIG.5
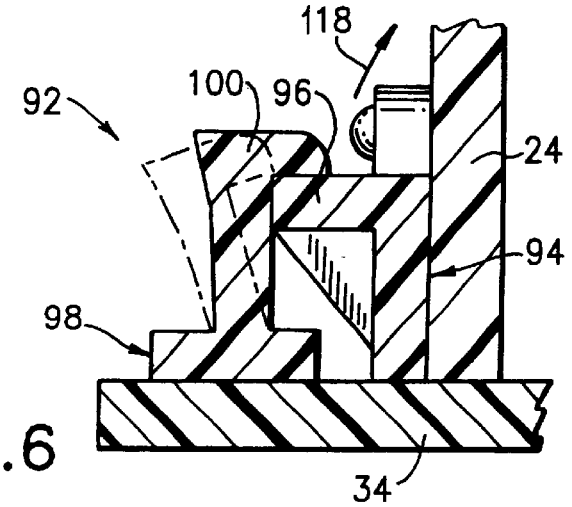
FIG.6

FOOTWEAR CLEANING APPARATUS

BACKGROUND OF THE INVENTION

1. Field of the Invention

The present invention relates generally to shoe cleaning apparatus and, more particularly, to such apparatus which is portable and which utilizes the motion of the user's foot to perform its functions and which does not require an external source of power.

2. Prior Art

Throughout this disclosure, the term"footwear" will be used to refer to all manner of footwear, whether shoes, boots, galoshes, slippers, or the like intended primarily for wear out of doors. Furthermore, use of any singular term of type of footwear will be intended to mean any other type as well. When a person returns indoors after walking through ice, snow, mud, dust, or other material, the presence of which is not desirable indoors, it is desirable to clean the footwear either just before entry or upon entry to make certain the undesirable material is not tracked further inside.

Shoe cleaning devices which utilize brushes for cleaning the various aspects of a shoe are well known. In general, such prior art devices utilize brushes which are either fixed or power driven. In the former instance, the user may simply move his shoe against fixed brushes to accomplish the cleaning, while in the latter instance, the shoe may be simply held fixed against the power driven brushes. Devices of the first class are generally inefficient, presenting the same brushing surface to the shoe at all times, which results in undue wear of and quick contamination of the brushes. Devices of the second class are often expensive and complicated.

SUMMARY OF THE INVENTION

The present invention relates to footwear cleaning apparatus which includes a housing having front and top walls with an opening for reception of footwear to be cleaned and a base on which the housing is supported. A first cylindrical brush positioned in the path of movement of the footwear is rotatably supported about a substantially horizontally disposed axis for rotation in a manner to clean the bottom of the footwear yielding to its insertion movement into the housing but preventing rotation in the opposite direction. A pair of second cylindrical brushes are oppositely positioned adjacent the path of movement of the footwear. The second brushes are rotatably supported about generally upright axes for cleaning the sides of the footwear also in a manner yielding to its insertion movement but preventing rotation in the opposite direction. A third cylindrical brush also positioned in the path of movement of the footwear for cleaning its upper surfaces is rotatably supported about a substantially horizontally disposed axis on an axle extending between upright mounting braces for rotation, yielding to insertion movement of the footwear but preventing rotation in the opposite direction. The housing encloses the first, second, and third brushes at least at the sides and at the end opposite that for insertion of the footwear and so much of the top and front thereof as is not required for insertion of the footwear.

The present invention provides a device which differs from power driven devices in that it does not require its own source of power and which differs from fixed brush devices in that the brushes are not always fixed and do not present the same working surface at all times. The unit of the invention is not electrically operated and is intrinsically a safe product.

The apparatus of the invention is essentially a domesticated version of a shoe cleaner which has been available commercially for many years. The unit disclosed is capable of cleaning a broad range of shoe sizes, for example, sizes 2 to 16, and at a 90% rate of removal of the contamination.

A unit of the invention may be located on the outside of an entry into a building or it may be placed inside a hallway or foyer of the building or at any other location where needed. There are numerous other locations which would be desirable for the apparatus of the invention, for example, golf courses, bocci courts, tennis courts, bowling allies, hospitals, businesses and numerous other places and for many other uses. Another important place may be at beaches, pools, showers (to disinfect feet) and other areas where bare feet are typically exposed.

Brushes for the invention may be of nylon construction, for example, and it is preferable that the bristles for the brushes be of such a character that they do not hold contamination or spread any particles that are of contagious nature. With these brushes, a spray system can be optionally employed to deliver liquids such as, disinfectants, water or other products to a receiving surface. Furthermore, these nylon bristles may vary in thickness if one needs more or less consistency for certain operations or functions.

Accordingly, a principal feature of the present invention is the provision of apparatus having these characteristics and advantages, and more specifically, to apparatus which is portable and which utilizes the motion of the user's feet to perform its functions and which does not require an external source of power.

Another feature of the present invention is the provision of such apparatus that is sturdy and capable of long trouble-free use, that is compact and readily portable, and that is more efficient than comparable known devices.

A further feature of the present invention is the provision of a device incorporating brushes which operate in accordance with a novel shoe cleaning principle, namely, compliance with the movement of a shoe in a first direction and resistance to the movement in a second direction.

Yet another feature of the present invention is the provision of a device of the aforesaid type that ensures adequate cleaning of the under and side surfaces of a shoe, which normally are subject to the greatest accumulation of dirt, and which cleans the upper surface of the shoe as well.

Still a further feature of the present invention is the provision of a device of the aforesaid type that is self-contained and yet readily exposed for servicing.

Yet a further feature of the present invention is the provision of a device of the aforesaid type that permits the ready disposal of dirt removed from the shoes.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

BRIEF DESCRIPTION OF THE DRAWINGS

The foregoing aspects and other features of the present invention are explained in the following description, taken in connection with the accompanying drawings, wherein:

FIG. 4 is a detail cross section view taken generally along line 4—4 in FIG. 3;

FIG. 5 is a detail side elevation view of the component illustrated in FIG. 4;

FIG. 6 is a detail cross section view of structure 8 illustrated in FIG. 3;

DETAILED DESCRIPTION OF THE PREFERRED EMBODIMENT

Figure 1:
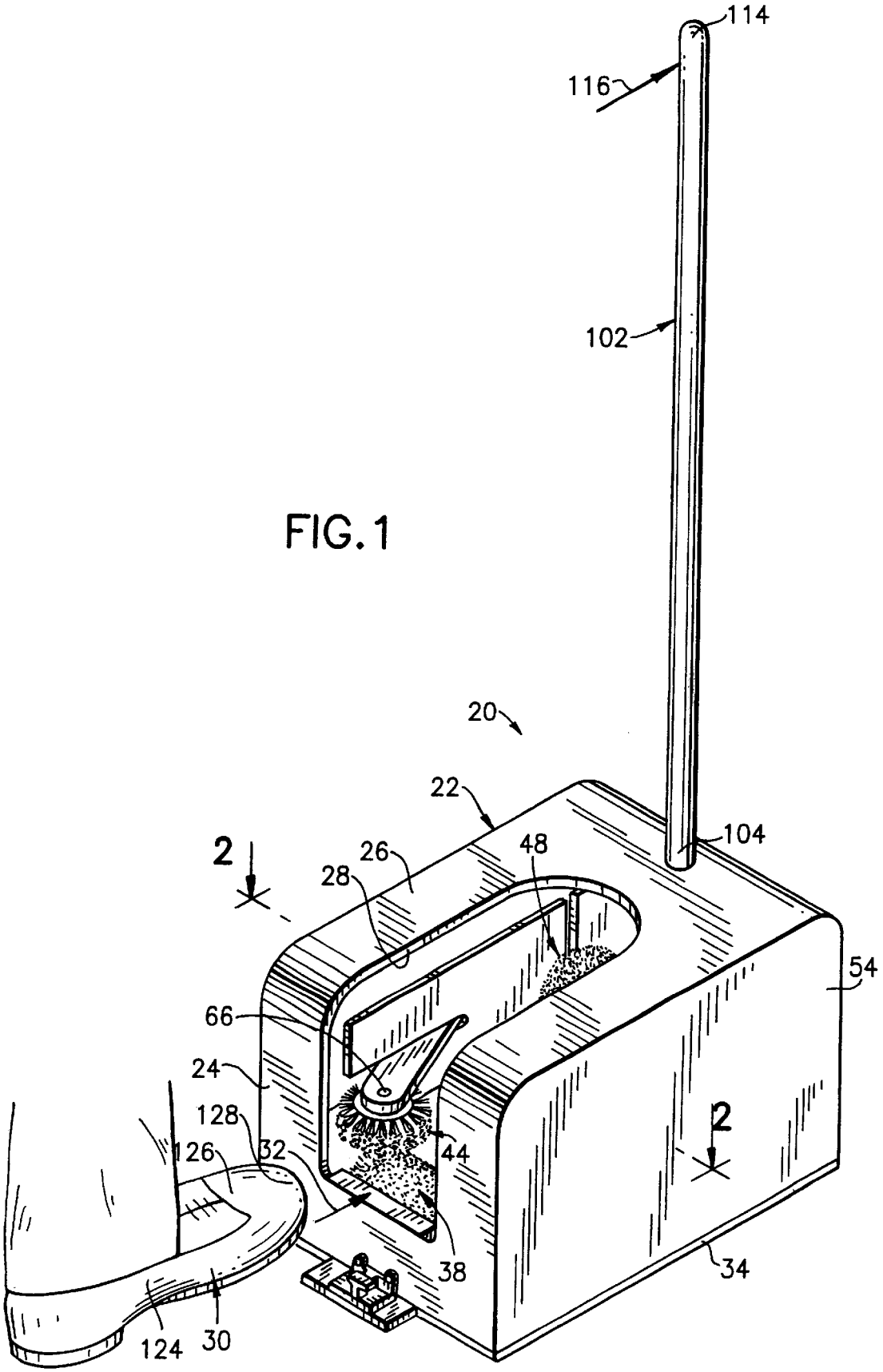
FIG. 1 is a perspective view of footwear cleaning apparatus embodying the present invention.

Referring to FIG. 1, there is shown a perspective view of footwear cleaning apparatus 20 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

Figure 2:
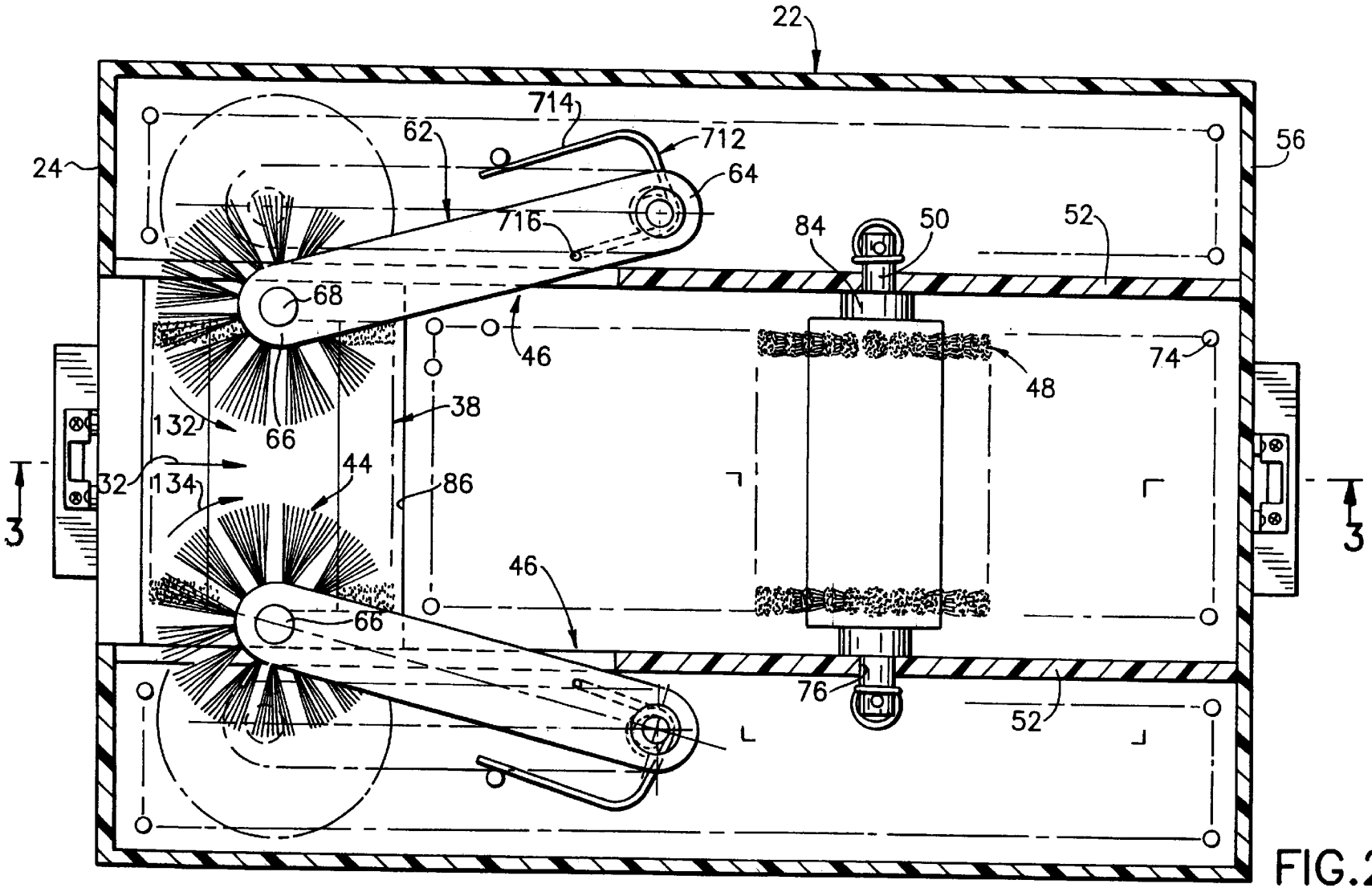
FIG. 2 is a cross section view taken generally along line 2—2 in FIG. 1.
Figure 3:
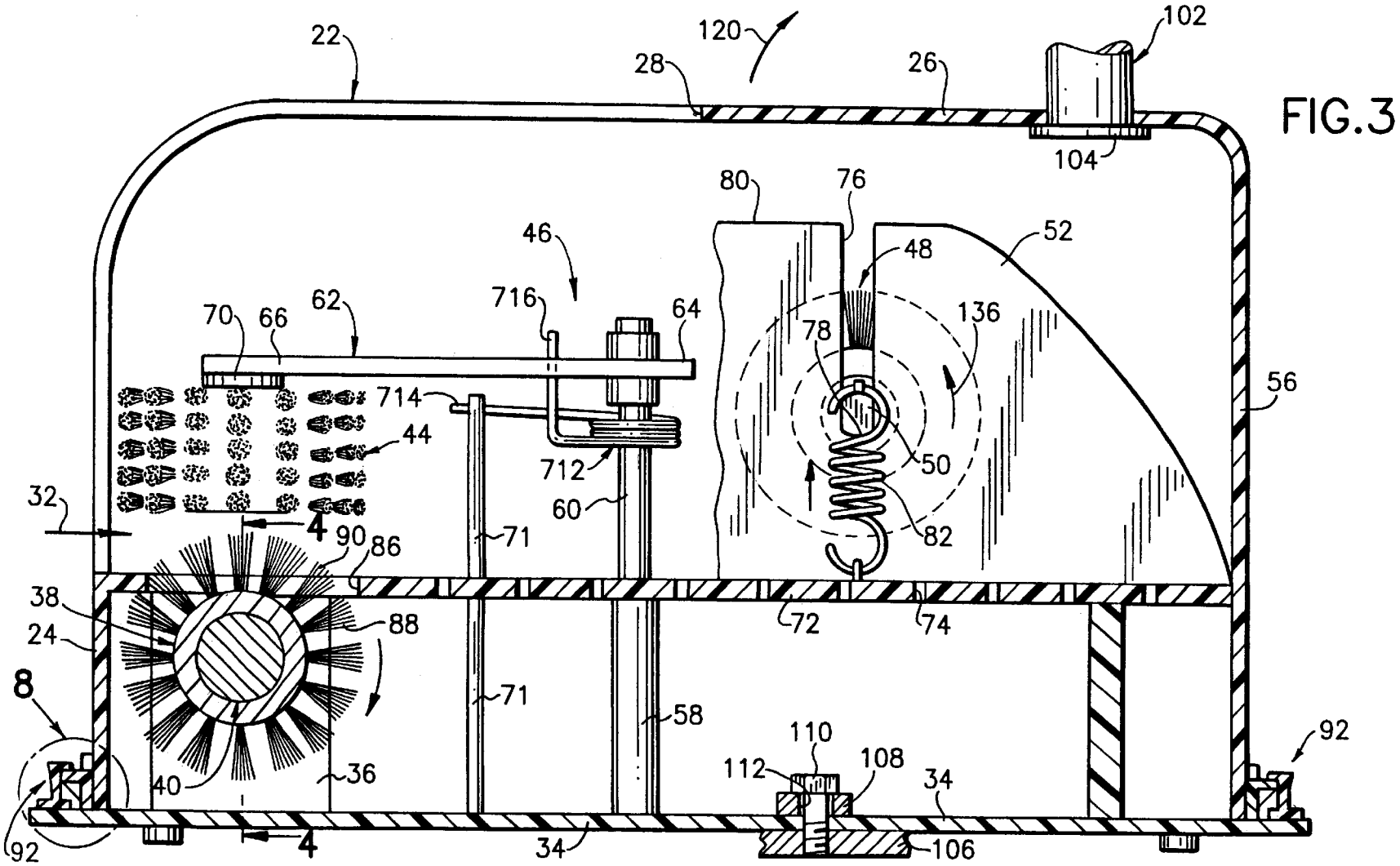
FIG. 3 is a cross section view taken generally along line 3—3 in FIG. 2.

Viewing now FIGS. 1–3, the footwear cleaning apparatus 20 is seen to include a housing 22 having a front wall 24 and a top wall 26 and an opening 28 which extends across the front wall, then across the top wall for reception of footwear 30 to be cleaned along a path of movement indicated by an arrow 32. A generally planar base 34 is provided for support of the housing. As more clearly seen in FIG. 4, a pair of spaced brackets 36 are mounted upright on the base 34 and a first cylindrical brush 38 is positioned in the path of movement of the footwear 30. A shaft 40 support the cylindrical brush 38 between the brackets 36 and the brush rotates on the shaft about a substantially horizontally disposed axis in a manner yielding to movement of the footwear upon insertion of the footwear into the housing but preventing rotation in the opposite direction. This effect is achieved by means of a one-way engaging clutch 42 which couples the shaft 40 and the brush 38. Each of the brackets 36 has an upright slot 362 (FIGS. 4 and 5) extending between a lower bearing surface 364 about midway of the distance between the base 34 and an upper edge 366. The shaft 40 is flattened at its ends 402 engaging the upright slot 362 and extends between the brackets 36 and is thereby fixed to the brackets. However, the brush 38 with its integral shaft 40 can easily be lifted from the slot 362 and away from the brackets 36 for maintenance and replacement.

With continued reference to FIGS. 1–3. a pair of second cylindrical brushes 44 are oppositely positioned adjacent the path of movement 32 of the footwear 30. A support assembly 46 rotatably supports each of the second brushes 44 for rotation about a generally upright axis. As with the brush 38, the brushes 44 are mounted in a manner yielding to the movement of the footwear upon insertion of the footwear but preventing rotation in the opposite direction.

A third cylindrical brush 48 is also positioned in the path of movement of the footwear. In this instance, an axle 50 supports the brush 48 between a pair of upright mounting braces 52 for rotation about a substantially horizontally disposed axis and, as with the brushes 38 and 44, for rotation in a manner yielding to movement of the footwear upon insertion of the footwear but preventing rotation in the opposite direction. As is clearly seen in FIG. 1, the housing 24 encloses the brushes 38, 44, and 48 at sides defined by side walls 54 and at an end wall 56 opposite the front wall 24 through which insertion of the footwear occurs and by so much of the top wall 26 and front wall 24 as is not required for insertion of the footwear. That is, the opening 28 is only sufficiently large to freely receive passage of footwear having a broad range of sizes, but really no larger than absolutely necessary.

Each support assembly 46 rotatably supporting one of the second brushes 44 includes an upright journal 58 fixed on the base 34 and upstanding from the base. A support shaft 60 is rotatably mounted in the upright journal 58. A support arm 62 is fixed at one end 64 to the support shaft 60 and extends to a free end 66. A stub shaft 68 (FIG. 2) is mounted at the free end 66 of the support arm 62 for rotation about an upright axis with a cylindrical brush 44 fixed on the stub shaft. In a suitable manner, each brush 44 and its associated stub shaft 68 is suitably detachable from the support arm 62 for removal and replacement. So that rotation of the brushes 44 only occurs in the direction yielding to the movement of the footwear upon insertion of the footwear while preventing rotation in the opposite direction, a one-way clutch 70 (FIG. 3) is provided coupling each brush with its associated stub shaft 68. Additionally, for each support assembly 46, an upstanding reaction post 71 is fixed at least to a platform 72 and possibly also to base 34 at a location spaced from the support shaft 60. A torsion spring 712 is axially mounted in a suitable manner on the support shaft and extends to first and second opposed ends, 714, 716, the end 714 being engaged with the reaction post 71, the end 716 being engaged with the support arm 62. With this construction, each second cylindrical brush 44 is biased laterally toward the path of movement of the footwear represented by the arrow 32. Of course, viewing FIG. 2, this means that the support assembly 46 closest to the reader is biased in the clockwise direction while the support assembly farthest from the reader is biased in the counterclockwise direction.

Still referring to FIGS. 1–3, the housing includes the platform 72 to slidingly receive the footwear when inserted into the housing. The platform 72 is integral with the remainder of the housing 22 and lies in a plane generally parallel to and spaced from the base 34 and is perforated, pierced with a large number of through holes 74 to enable particulate matter from the footwear to descend through the platform and be collected on the base for future disposal in a suitable manner.

The upright mounting braces 52 are fixed on the platform 72 and lie in parallel spaced-apart planes which are generally aligned with the direction of insertion (see arrow 32) of the footwear 30 into the housing and withdrawal of the footwear from the housing. Each of the mounting braces 52 has an upright slot 76 (FIGS. 2 and 3) extending between a lower bearing surface 78 about midway of the distance between the platform 72 and an upper edge 80. The axle 50 is flattened at its ends engaging the upright slot 76 and extends between the upright mounting braces and is thereby fixed to the mounting braces. A tension spring 82 is provided adjacent each mounting brace 52, fixed at its opposite ends, respectively, to the platform 72 and to an associated end of the axle 50 to bias the axle toward the lowered position, that is, into engagement with the lower bearing surfaces 78 of the upright slots 76. In the same manner as with the brushes 44 and 38, a one-way clutch 84 (FIG. 2) is provided coupling the brush 48 with the axle 50 so that rotation of the brush only occurs in the direction yielding to the movement of the footwear upon insertion of the footwear while preventing rotation in the opposite direction. The springs 82 can be readily detached from the axle 50 enabling the brush 48 to be removed and replaced.

As best seen in FIGS. 1 and 2, the platform 72 has a window 86 adjacent the front wall 24 of the housing 22. The axis of rotation of the first cylindrical brush 38 is parallel to both the front wall 24 and the top wall 26 of the housing. As with the brushes 44 and 48, the brush 38 has a plurality of bristles 88 which extend radially to tip ends 90 and, in this instance, as the brush 38 rotates, the tip ends 90 project through the window 86 for engagement with the footwear 30 as it proceeds along the path of movement (see arrow 32).

As seen in FIGS. 1–3 and most clearly in FIG. 6, a mutually engageable locking mechanism 92 is provided for releasably fixing the housing 22 to the base 34. The locking mechanism 92 includes a first locking member 94 fixed to the front wall 24 of the housing 22 and including an outwardly projecting ledge 96. A second locking member 98 is fixed to the base 34 and includes a flexible flange member 100 movable between a lock position (solid lines in FIG. 5) engaged with the projecting ledge 96 and a release position (dashed lines in FIG. 6) disengaged from the projecting ledge.

As seen in FIGS. 1 and 3, an elongated upright handle 102 is suitably fixed to the housing 22 at a lower end 104 for support of a person using the apparatus 20. Also, it may be desirable to mount the base 34 to an underlying substrate 106. For this purpose, a strengthened region 108 integral with the base may receive a suitable fastener 110 through a clearance hole 112 for threaded engagement with the substrate. In such an event, if it is desired to gain entry into the interior of the housing 22 for any reason, a user may push an uppermost end 114 of the handle 102 in the direction of an arrow 116. With movement of the handle 102, the ledge 96 is pivoted upwardly in the direction of an arrow 118 (FIG. 6) thereby forcing the flexible flange member to move from the solid line condition to the dashed line condition. When this occurs, the entire housing 22 can pivot in the direction of an arrow 120 (FIG. 3) about the locking mechanism 92 adjacent the end wall 56 and the ledge 96 of that locking mechanism can thereafter be removed by the user from engagement by its associated flange member. In this manner, the housing 22 can be completely removed from the base 34. By reversing this process, the housing 22 can be returned into engagement with the base 34. Of course, such a locking and release procedure can also be performed without using the handle 102. Also, with the base 34 mounted to the underlying substrate, theft of at least the major portion of the apparatus 20 may be prevented.

Figure 7:
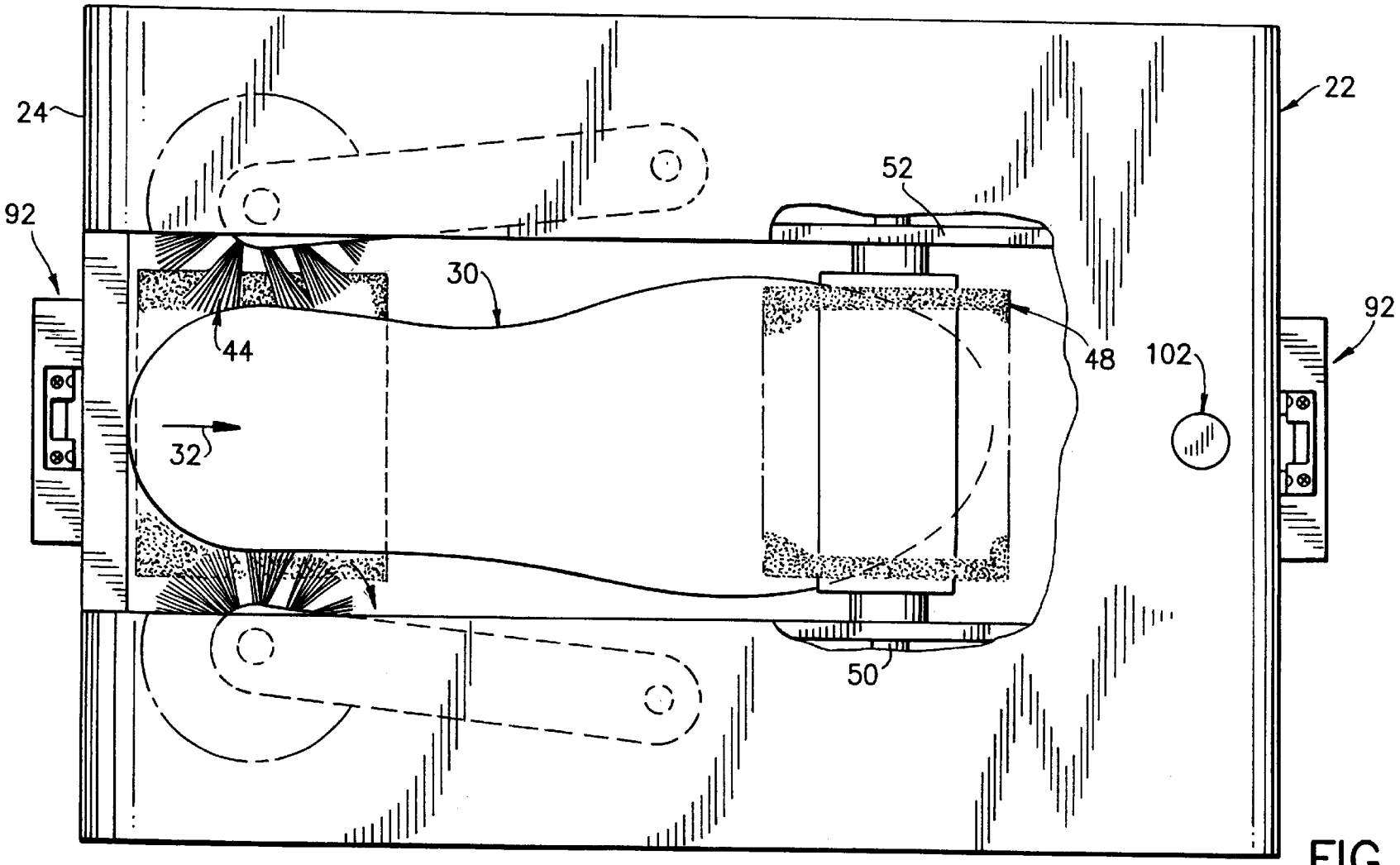
FIG. 7 is a top plan view, generally similar to FIG. 2 and illustrating footwear in a cleaning position within the cleaning apparatus of the invention.
Figure 8:
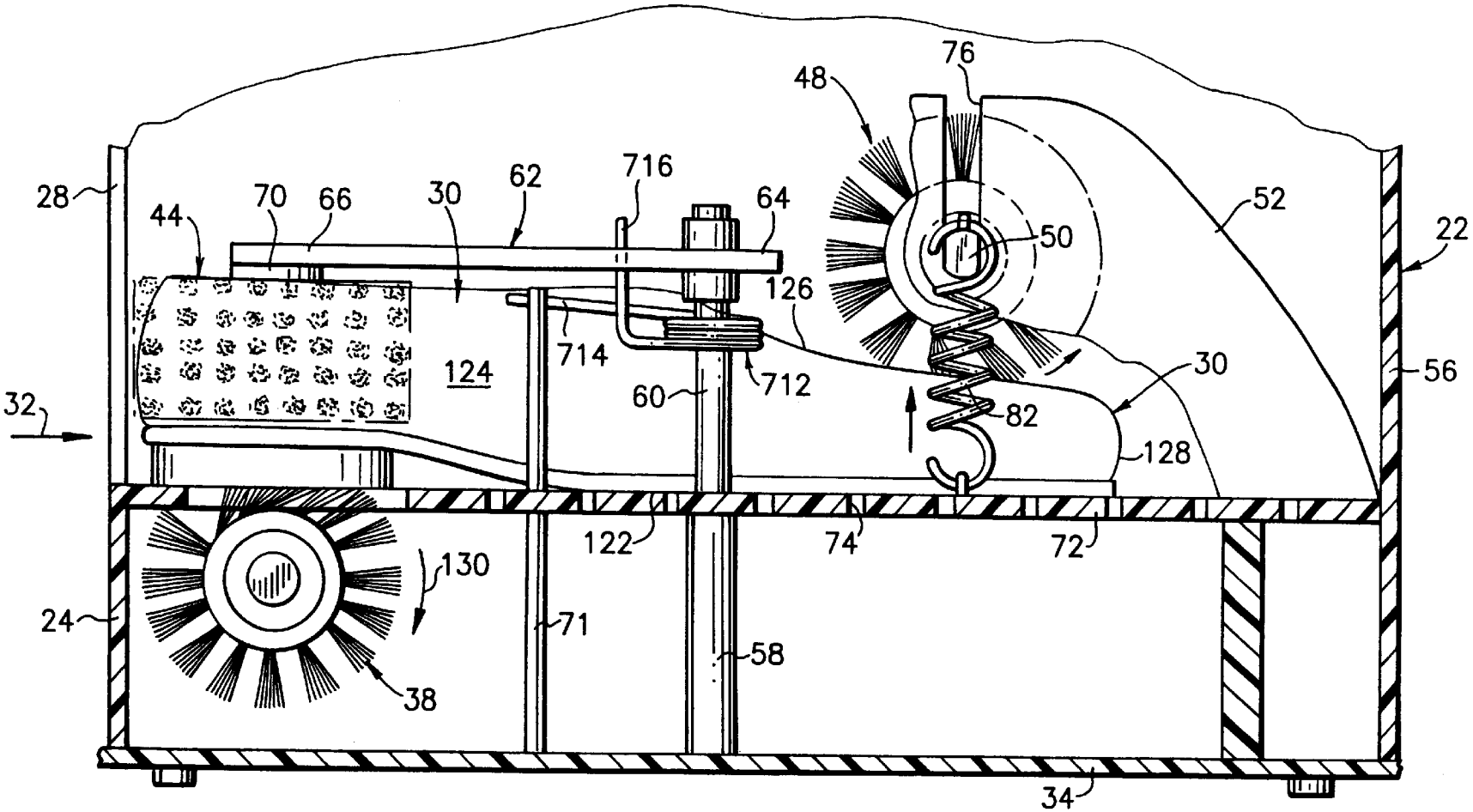
FIG. 8 is a side elevation view, generally similar to FIG. 3 and illustrating footwear in a cleaning position within the cleaning apparatus of the invention.

In operating the apparatus 20, viewing FIGS. 7 and 8, a user holds the upright handle 102 with at least one hand and inserts his or her foot bearing the footwear 30 in the direction of arrow 32 through the opening 28 in gliding engagement with the surface of the platform 72. A bottom surface 122 (FIG. 8) of the footwear 30 is engaged and stroked by the brush 38 as the brush rotates in the direction of an arrow 130 (FIG. 8) and thereafter moves into engagement with the platform 72. Simultaneously, the lateral surfaces 124 of the footwear 30 are engaged and stroked by the brushes 44 as they rotate, respectively, in the directions of arrows 132, 134 (FIG. 2). With continued entry of the footwear 30 into the housing 22, the upper surfaces 126 of the footwear are engaged and stroked by the brush 48 as the brush rotates in the direction of an arrow 136 (FIG. 3) and the spring 82 causes the brush to bear firmly into engagement with the footwear as it passes underneath the brush. The user continues to insert the foot either until the front surface 128 of the footwear moves into engagement with the end wall 56 or until the footwear has been adequately stroked by the brushes 38, 44, and 48. The user then removes the footwear from the housing 22 in a direction opposite the arrow 32 and at this stage of the operation, the brushes are fixed against rotation by reason of the one-way clutches 42, 70, and 84, respectively. It is in this removal step that most of the contamination on the footwear is removed. It may be desirable to perform this operation several times with each item of footwear to achieve maximum cleaning.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. Footwear cleaning apparatus comprising:

a housing having a front wall and a top wall and an opening therein for reception of footwear to be cleaned along a path of movement;

a base supporting the housing thereon;

a pair of spaced brackets mounted upright on the base;

a first cylindrical brush positioned in the path of movement of the footwear;

a shaft rotatably supporting the first cylindrical brush between the brackets about a substantially horizontally disposed axis for rotation in a manner yielding to movement of the footwear upon insertion of the footwear into the housing but preventing rotation in the opposite direction;

a pair of second cylindrical brushes oppositely positioned adjacent the path of movement of the footwear;

a support assembly rotatably supporting each of the second brushes about generally upright axes for rotation in a manner yielding to the movement of the footwear upon insertion of the footwear but preventing rotation in the opposite direction;

a third cylindrical brush positioned in the path of movement of the footwear;

a pair of spaced upright mounting braces;

an axle rotatably supporting the third cylindrical brush between the upright mounting braces about a substantially horizontally disposed axis for rotation in a manner yielding to movement of the footwear upon insertion of the footwear but preventing rotation in the opposite direction;

the housing enclosing the first, second, and third brushes at least at the sides and at the end opposite that for insertion of the footwear and so much of the top and front thereof as is not required for insertion of the footwear;

wherein the axle with the third cylindrical brush thereon is movable between raised and lowered positions; and wherein spring members bias the axle to a lowered position for engagement of the third cylindrical brush with the footwear when the footwear is inserted into the housing.

2. Footwear cleaning apparatus as set forth in claim 1 including:

a first one-way engaging clutch coupling the first cylindrical brush and the shaft therefor;

a second one-way engaging clutch coupling each of the second cylindrical brushes and the support assembly therefor; and a third one-way engaging clutch coupling the third cylindrical brush and the axle therefor.

3. Footwear cleaning apparatus as set forth in claim 1 wherein each support assembly rotatably supporting one of the second brushes includes:

an upright journal fixed on the base and upstanding therefrom;

a support shaft rotatably mounted in the upright journal;

a support arm fixed at one end to the support shaft and extending to a free end;

a stub shaft mounted at the free end of the support arm for rotation about an upright axis; and one of the second cylindrical brushes fixed on each stub shaft.

4. A Footwear cleaning apparatus as set forth in claim 1 wherein the housing has an opening to accommodate insertion of the footwear for engagement by the first, second, and third cylindrical brushes, then withdrawal of the footwear; and wherein the first cylindrical brush is positioned adjacent the opening for engagement with undersurfaces of the footwear;

wherein the second cylindrical brushes are positioned adjacent the opening for engagement, respectively, with opposed lateral surfaces of the footwear; and wherein the third cylindrical brush is positioned distant from the opening for engagement with upper surfaces of the footwear.

5. Footwear cleaning apparatus as set forth in claim 1 wherein the housing includes:

a platform for the footwear when inserted into the housing the platform lying in a plane generally parallel to and spaced from the base, the platform being perforated to enable particulate matter from the footwear to descend therethrough onto the base.

6. Footwear cleaning apparatus as set forth in claim 5 wherein the spaced upright mounting braces are fixed on the platform and lie in parallel planes generally aligned with the direction of insertion of the footwear into the housing and withdrawal of the footwear from the housing; and wherein each of the upright mounting braces has an upright slot, the axle extending between the upright mounting braces and mounted at its opposite ends on the lower bearing surfaces; and including:

a pair of tension springs, each fixed at its opposite ends to the platform and to an associated end of the axle to bias the axle toward the lowered position.

7. Footwear cleaning apparatus as set forth in claim 5 wherein the platform has a window adjacent the front wall of the housing;

wherein the axis of rotation of the first cylindrical brush on the shaft is parallel to both the front wall and the top wall of the housing;

wherein the first cylindrical brush has a plurality of bristles which extend radially to tip ends; and wherein the tip ends of the first cylindrical brush project through the window in the platform for engagement with the footwear as it proceeds along the path of movement.

8. Footwear cleaning apparatus as set forth in claim 5 including:

an upright journal fixed on the base and upstanding therefrom; and wherein each support assembly rotatably supporting one of the second brushes includes:

a support shaft rotatably mounted in the upright journal;

a support arm fixed at one end to the support shaft and extending to a free end;

a stub shaft mounted at the free end of the support arm for rotation about an upright axis; and one of the second cylindrical brushes fixed on each stub shaft; and including:

a reaction post fixed to and upstanding from the platform and spaced from the support shaft;

a torsion spring axially mounted on the support shaft and extending to first and second opposed ends, a first end engaged with the reaction post, a second end engaged with the support arm and biasing the second cylindrical brush laterally toward the path of movement of the footwear.

9. Footwear cleaning apparatus as set forth in claim 1 including:

a mutually engageable locking mechanism for releasably fixing the housing to the base.

10. Footwear cleaning apparatus as set forth in claim 1 including:

an elongated upright handle fixed to the housing for support of a person using the apparatus.

11. Footwear cleaning apparatus as set forth in claim 1 wherein the brackets supporting the first cylindrical brush enable removal and replacement of the brush therefrom;

wherein the support assembly for the second cylindrical brush enables removal and replacement of the brush therefrom; and wherein the upright mounting braces for the third cylindrical brush enable removal and replacement of the brush therefrom.

12. Footwear cleaning apparatus comprising:

a housing having a front wall and a top wall and an opening therein for reception of footwear to be cleaned along a path of movement;

a base supporting the housing thereon;

a pair of spaced brackets mounted upright on the base;

a first cylindrical brush positioned in the path of movement of the footwear;

a shaft rotatably supporting the first cylindrical brush between the brackets about a substantially horizontally disposed axis for rotation in a manner yielding to movement of the footwear upon insertion of the footwear into the housing but preventing rotation in the opposite direction;

a pair of second cylindrical brushes oppositely positioned adjacent the path of movement of the footwear;

a support assembly rotatably supporting each of the second brushes about generally upright axes for rotation in a manner yielding to the movement of the footwear upon insertion of the footwear but preventing rotation in the opposite direction;

a third cylindrical brush positioned in the path of movement of the footwear;

a pair of spaced upright mounting braces;

an axle rotatably supporting the third cylindrical brush between the upright mounting braces about a substantially horizontally disposed axis for rotation in a manner yielding to movement of the footwear upon insertion of the footwear but preventing rotation in the opposite direction;

the housing enclosing the first, second, and third brushes at least at the sides and at the end opposite that for insertion of the footwear and so much of the top and front thereof as is not required for insertion of the footwear; and wherein each support assembly rotatably supporting one of the second brushes includes:

an upright journal fixed on the base and upstanding therefrom;

a support shaft rotatably mounted in the upright journal;

a support arm fixed at one end to the support shaft and extending to a free end;

a stub shaft mounted at the free end of the support arm for rotation about an upright axis; and one of the second cylindrical brushes fixed on each stub shaft.

13. Footwear cleaning apparatus as set forth in claim 12 including:

spring members biasing the second cylindrical brushes toward one another.

14. Footwear cleaning apparatus comprising:

a housing having a front wall and a top wall and an opening therein for reception of footwear to be cleaned along a path of movement;

a base supporting the housing thereon;

a pair of spaced brackets mounted upright on the base;

a first cylindrical brush positioned in the path of movement of the footwear;

a shaft rotatably supporting the first cylindrical brush between the brackets about a substantially horizontally disposed axis for rotation in a manner yielding to movement of the footwear upon insertion of the footwear into the housing but preventing rotation in the opposite direction;

a pair of second cylindrical brushes oppositely positioned adjacent the path of movement of the footwear;

a support assembly rotatably supporting each of the second brushes about generally upright axes for rotation in a manner yielding to the movement of the footwear upon insertion of the footwear but preventing rotation in the opposite direction;

a third cylindrical brush positioned in the path of movement of the footwear;

a pair of spaced upright mounting braces;

an axle rotatably supporting the third cylindrical brush between the upright mounting braces about a substantially horizontally disposed axis for rotation in a manner yielding to movement of the footwear upon insertion of the footwear but preventing rotation in the opposite direction;

the housing enclosing the first, second, and third brushes at least at the sides and at the end opposite that for insertion of the footwear and so much of the top and front thereof as is not required for insertion of the footwear;

a mutually engageable locking mechanism including:

a first locking member fixed to the housing and including an outwardly projecting ledge; and a second locking member fixed to the base and including a flexible flange member movable between a lock position engaged with the projecting ledge and a release position disengaged from the projecting ledge.

* * * * *